US005088253A

United States Patent [19]

Christ

[11] Patent Number: 5,088,253

[45] Date of Patent: Feb. 18, 1992

[54] METHOD AND APPARATUS FOR HOUSING AND WASTE DISPOSAL

[76] Inventor: Gary W. Christ, 5309 Briarwood, Woodstock, Ill. 60098

[21] Appl. No.: 600,864

[22] Filed: Oct. 22, 1990

[51] Int. Cl.[5] ..... E04C 1/40

[52] U.S. Cl. ..... 52/309.7; 52/576; 52/577; 52/DIG. 9; 52/405

[58] Field of Search ..... 428/903.3; 256/73; 52/DIG. 9, 309.7, 576, 577, 405, 747, 741

[56] References Cited

U.S. PATENT DOCUMENTS

| | | | |
|---|---|---|---|
| 1,390,073 | 9/1921 | Allen | 52/648 |
| 1,559,837 | 11/1925 | Allen | 52/663 |
| 1,986,172 | 1/1935 | Wilson | 52/712 |
| 2,832,212 | 4/1958 | Olsen | 52/712 |
| 3,601,935 | 8/1971 | Cadwell | 52/DIG. 9 |
| 4,465,262 | 8/1984 | Riley | 256/24 |

*Primary Examiner*—James L. Ridgill, Jr.
*Attorney, Agent, or Firm*—Mathew R. P. Perrone, Jr.

[57] ABSTRACT

A house can be formed of tires by securing tires in a panel and using the panel to form a wall of a house or other structure.

20 Claims, 4 Drawing Sheets

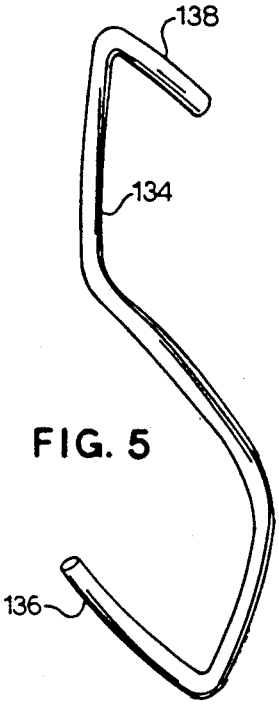
FIG. 5
FIG. 7
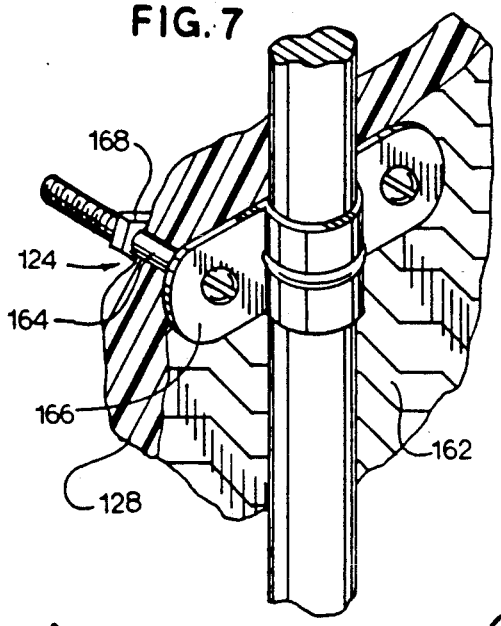
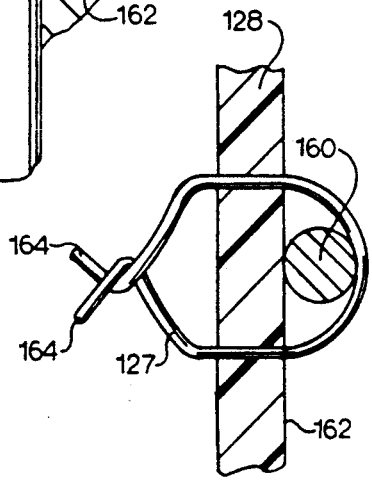
FIG. 6
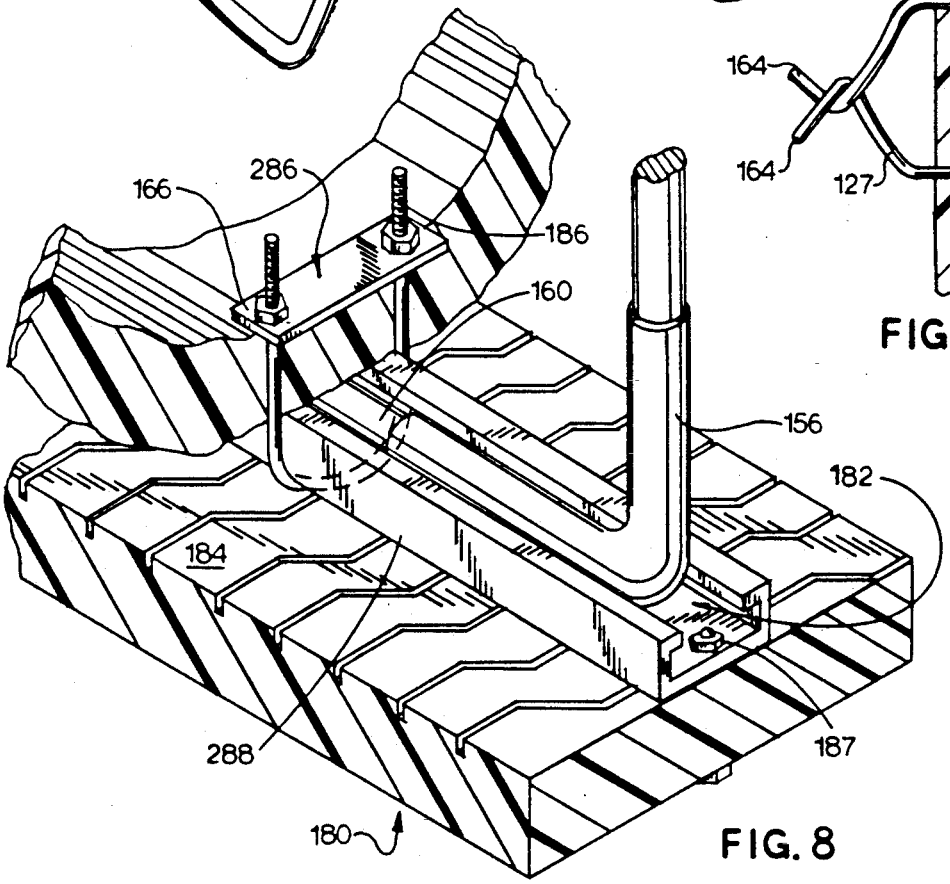
FIG. 8

METHOD AND APPARATUS FOR HOUSING AND WASTE DISPOSAL

This invention relates to a method and apparatus for providing housing while simplifying waste disposal, and more particularly to a method and apparatus for using discarded vehicle tires to provide inexpensive housing.

BACKGROUND OF THE INVENTION

It is well known that the problems of the homeless and the environment are major issues. At times, there almost appears to be no solution for these problems. It is difficult to provide inexpensive housing for the homeless. It is equally difficult to provide solutions to environmental problems.

From an environmental standpoint, it has proven especially difficult to provide for disposal of vehicle tires. Such disposal is especially difficult with automobile tires because of the large number of those tires and the high volume of space occupied by the tires.

Because a tire is extremely stable, it is hard to dispose of a tire. A tire does not decompose in a reasonable time. If a tire with insufficient tread to be useful is left whole, it provides an excellent breeding ground for mosquitoes, when water collects therein. Burial of a tire does not work, because a tire will eventually work its way out of the burial site. The buried tire clearly does not decompose and can occupy a great volume of a landfill.

The high stability of a tire mitigates against the destruction of the tire. Some efforts are known to burn a tire. Such burning, however, causes pollution. For the most part, the burning destroys material used in the tire and prevents reuse thereof. Again, the stability makes tire hard to burn. Such burning can also create pollution without the use of extremely expensive and careful controls.

Most attempts to solve the problem of the homeless have failed. A possible solution is an inexpensive structure which may be quickly set up, while maintaining the required strength and support.

If a method and apparatus can be developed to use tires to provide inexpensive housing, two major problems are solved. Not only do the people requiring inexpensive housing have it available, but also the difficulties involved in disposal of the tires are avoided in an effective fashion while, at the same time, solving a major, seemingly unrelated, problem in the field of housing. Waste can thus be solution to a problem.

SUMMARY OF THE INVENTION

Therefore, among the many objectives of this invention is to provide a method for solving an environmental problem.

A further objective of this invention is to provide a method for solving a housing problem.

A still further objective of the invention is to provide a device for solving an environmental problem.

Yet a further objective of the invention is to provide a device for solving a housing problem.

Also a further objective of this invention is to provide a device which utilizes a discarded tire for housing material.

Another objective of this invention is to provide a device to use an otherwise discarded tire.

Yet another objective of this invention is to provide a method for utilizing discarded tires for housing material.

Still another objective of this invention is to provide a method for using an otherwise discarded tire.

A further objective of this invention is to provide a method for reducing mosquito breeding grounds.

A still further objective of this invention is to provide a device for reducing mosquito breeding grounds.

Yet a further objective of the invention is to avoid burning of a tire.

Also a further objective of this invention is to provide a reuse of a discarded tire.

These and other objects of this invention are met by providing a panel including a frame to contain a plurality of tires therein, a tire fastening device for joining a tire to another tire, and a frame fastening device for joining a tire to the frame; and a frame support secured to the panel.

BRIEF DESCRIPTION OF THE DRAWINGS

FIG. 5 depicts a perspective view of a tire fastener 122.

FIG. 6 depicts a top, partial cross-sectional view of a first frame fastener 124.

FIG. 7 depicts a perspective view of a second frame fastener 224.

FIG. 8 depicts a close-up view of a frame support 180.

Throughout the figures of the drawings where the same part appears in more than one figure of the drawings, the same number is applied thereto.

DESCRIPTION OF THE PREFERRED EMBODIMENTS

An inexpensive house can be formed from a plurality of panels using discarded tires. Each panel is formed from a plurality of tires mounted in a frame. Generally, the tires are secured in the frame with a two by four arrangement or a two by three arrangement depending on the size of the tires.

A severed tire sidewall (also known as a tire bead is secured to and between adjacent four tires positioned in the general shape of a square. Preferably any suitable fastening means may be used to secure the four adjacent tires to the severed sidewall. However, the appropriate securing means is an S-shaped hook. One end of the hook fits into and at least partially around the bead of the severed sidewall, while the other end fits into the interior of the bead of one of the tires. The securing of the severed sidewall to the tires in this fashion strengthens the support panel immensely. The support panel includes a frame therearound.

The tires are bolted or otherwise secured to the frame. In a preferred fashion, a U-shaped member is forced through the tire and around the frame followed by crimping of the ends of the U-shaped member around the frame. This provides very solid strong base.

The frame can be mounted in a channel secured to a support member. The support member may be the tread of a tire. Thus, it is possible to use a tire tread as a support. The channel is generally a U-shaped member with the base thereof secured to the tire tread. The frame with the tires is then secured on one side in the U-shaped member and on an adjacent side to a second frame. Especially preferred is the very large truck tires wherein the tread, when severed from tire body, can be three meters or more (ten feet) long so that the tread can have a channel secured thereto and support two or three frames.

The frame material is, of course, any suitable rigid material. Most preferably the frame is metallic in nature. The the frame may be metal bars bent or otherwise to form the frame. The bars may also be joined by a corner piece. The parts of the frame may also be telescoping in nature in order to achieve the desired frame size for the tires.

Any suitable device may be used to join one frame to another frame. An appropriate device is a strapping mechanism or a clamp. The frames, thus clamped together and to the support member, can be filled with any suitable insulation and covered with any suitable outside and interior coating to present a durable exposure to the outside and a pleasant interior for the house. Insulation can be set in between the frames or the tires thereof, or air can be a suitable insulation.

Figure 1:
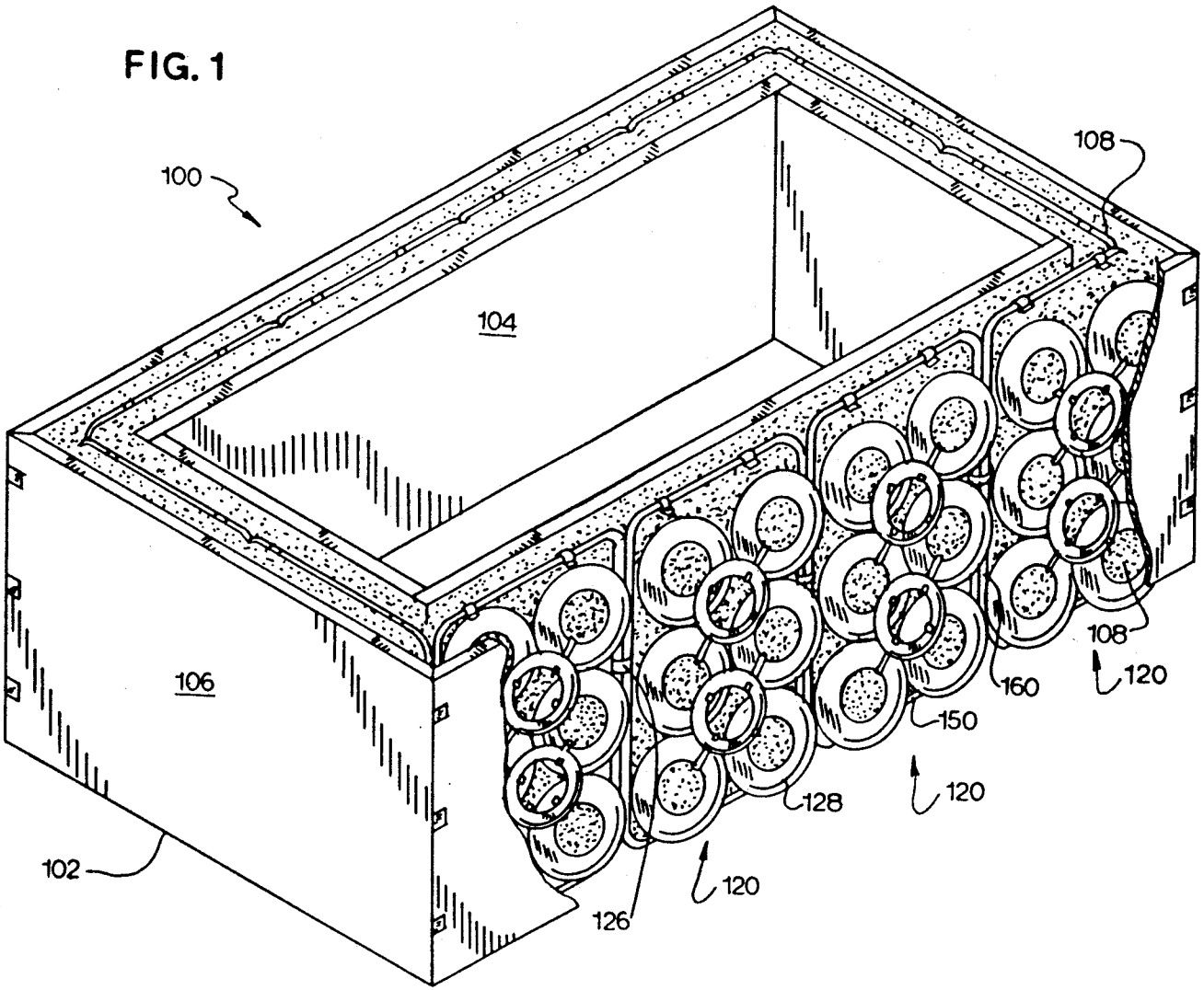
FIG. 1 depicts a perspective view of a tire house 100 made of a plurality of tire panels 120.

Referring now to FIG. 1, a tire house 100 is made of a plurality of tire panels 120. A first panel 120 is secured to a second panel 120 by at least one panel clamp 126. A plurality of panels 120 form the wall 102 of house 100. The wall 102 is completed by interior cover 104 and exterior cover 106, with insulation 108 placed therebetween. Interior cover 104, exterior cover 106, and insulation 108 are formed of any standard material.

Three panel clamps 126 are preferred to join adjacent panels 120. A typical panel clamp is a standard hose clamp well known in the automotive field. Panel 120 includes a frame 150 and a plurality of tires 128. Frame 150 includes a rod 160. Panel clamp 126 holds a first rod 160 in parallel, adjacent or tangential fashion to a second rod 160 to thereby join two of frame 150 and thereby two of panel 120 together. Panel clamp 126 is replaceable with any suitable panel clamping device capable of providing the strength and support for tire house 100.

Figure 3:
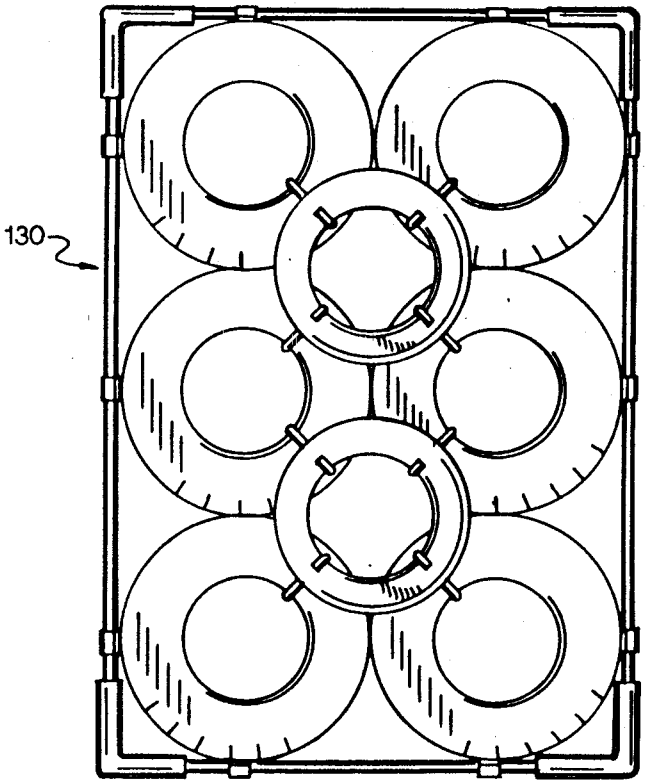
FIG. 3 depicts a front plan view of a six tire panel 130.
Figure 2:
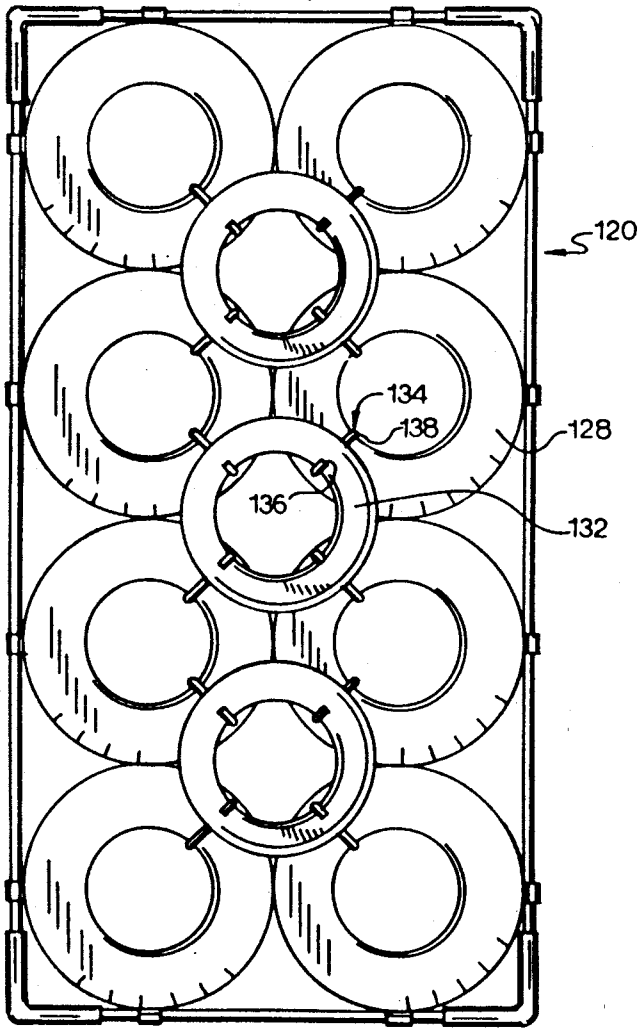
FIG. 2 depicts a front plan view of an eight tire panel 120.

FIG. 2 depicts a front plan view of the eight-tire panel 120. Any number of tires may be used in a tire panel 120. A typical variation is shown in FIG. 3 with six-tire panel 130. The size of a panel 120 depends on the size of the tire and size of the house 100 being built. House 100 can be adjusted in size and serve any desired purpose requiring a shelter, such as a garage or commercial building.

A tire 128 is secured both to tire sidewall 132 and to tire frame 150. The preferred form of tire fastener 122 (best shown in FIG. 5) for securing tire 128 to tire sidewall 132 is S-hook 134. S-hook 134 has a first end as a bead end 136 secured or hooked to tire sidewall 132 and an opposing second end as a tire end 138 secured or hooked in tire 128. The flexibility of tire 128 and tire sidewall 132 provides for a secure attachment therebetween due to the hooking mechanism.

Figure 4:
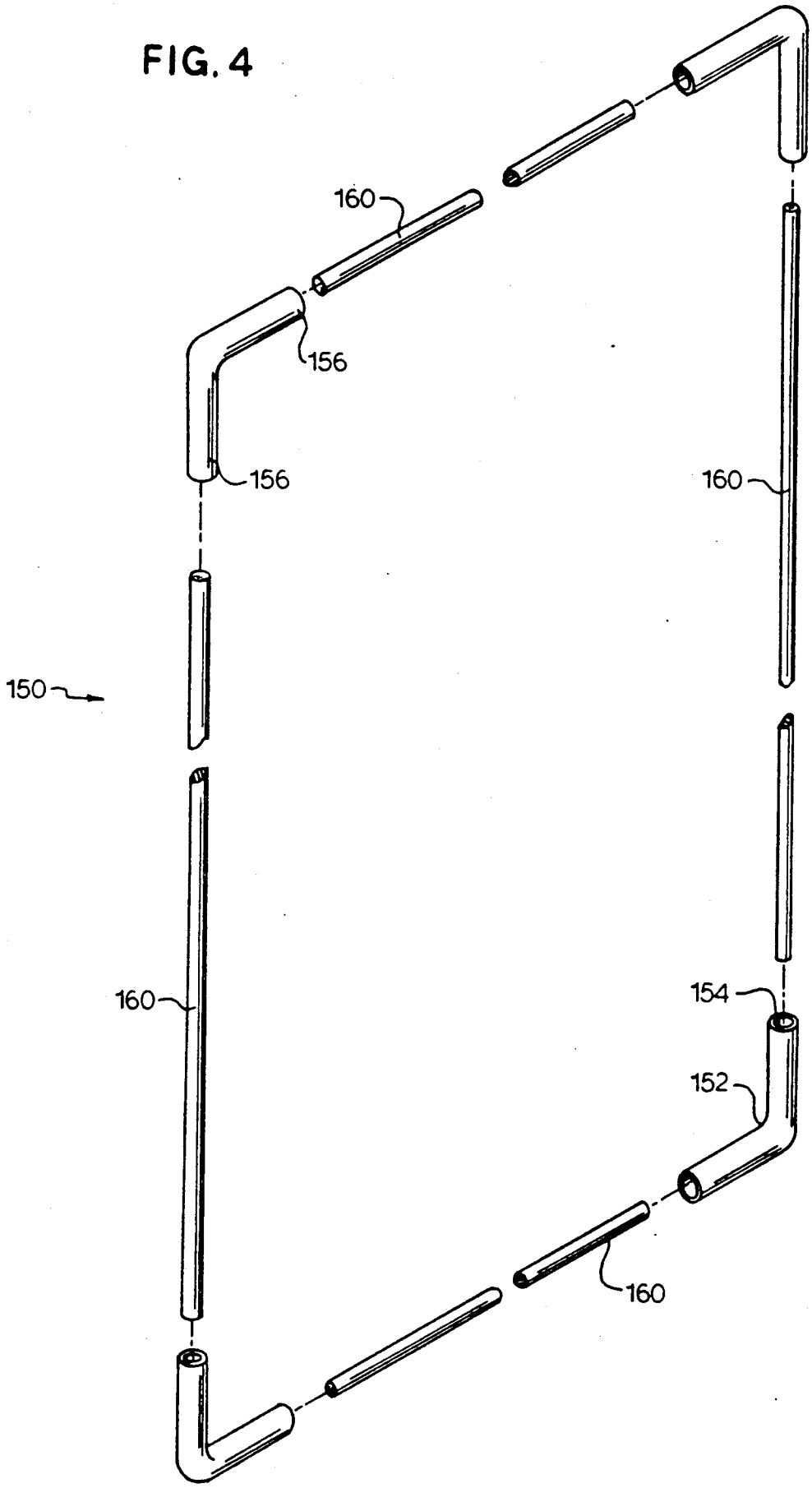
FIG. 4 depicts a perspective view of a tire frame 150.

By considering FIG. 4, the structure of tire frame 150 becomes clear. A corner piece 152 is generally arcuate in shape. The arc is preferably a suitable 90° arc. Corner piece 152 has a rod receiving aperture 154 in each end 156 thereof. Each aperture 154 receives rod 160 therein, with rod 160 serving as the male member of a male-female relationship. The reverse relationship is also feasible. Thus, four corner pieces 152 and four rods 160 form tire frame 150.

It is also quite apparent that rod 160 can be more than one piece and join in telescoping fashion. Both rod 160 and corner piece 152 can be made of any suitable strong material such as metal or plastic. It is possible to weld, mold or otherwise shape frame 150.

FIG. 6 depicts a preferred version of first frame fastener 124. First frame fastener 124 is preferably a U-shaped member 127, which is forced through the tread 162 of tire 128 and around the frame 150 followed by crimping of each end 164 of the U-shaped member 127 around the frame 150.

A second frame fastener 224 as a modification of first frame fastener 124 is shown in FIG. 7. Second frame fastener 224 includes tread bolt 164 to receive flange 166 at an end thereof. Flange 166 receives frame 150 therebetween. The threaded end of tread bolt 164 passes through the tread of tire 128 and receives nut 168 thereon to hold tire 128 and frame 150 in place. More than one frame fastener of any type may be used with tire 128. Second frame fastener 224 may also include nut bar 292 shown in FIG. 8.

FIG. 8 depicts a highly preferred frame support 180. The frame support 180 includes a U-shaped channel 182 secured to a flattened tire tread 184. One rod 160 of frame 150 fits into channel 182 by slidably mounting therein. Channel 182 combines with flattened tire tread 184 to form frame support 180. Channel 182 is secured to flattened tire tread 184 channel fastener 186.

A first channel fastener 186 may be at least one nut and bolt assembly, at least one staple, at least one of another suitable fastening member, or combinations thereof. Nut and bolt assembly 187 is preferred for channel fastener 186. Especially preferred is the very large truck tires wherein the flattened tread 184 can be three meters (ten feet) long or more so that the flattened tread can have channel 182 secured thereto and support two or three frames 150.

A second channel fastener 286 is also possible. It includes a U-shaped channel member 288 with each channel end 290 threaded to slidably receive dual-apertured nut bar 292. Channel nut 292 threadedly fits over threaded channel end 290 and nut bar 292 to lock tire 128 in place. Second channel fastener 286 may pass through flattened tire tread 184 around channel 182 and frame 150 into tire 128 for a secure fastening. A modified threaded nut bar 292 may also be used with second frame fastener 224.

The frames are or course any suitable rigid material. Most preferably the frames are metallic in nature. They may be telescoping in nature in order to achieve the desired frame size for the specific tires 128 used.

This application—taken as a whole with the specification, claims, abstract, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this method and game can become clear to a person having ordinary skill in this particular art. Such modifications are clearly covered by this disclosure.

What is claimed and sought to be protected by Letters Patent of the United States is:

1. A house using a tire frame assembly to form a wall of said house, wherein:
a. said tire frame assembly includes a support panel;
b. said support panel includes a frame mechanism, at least four tires mounted in said frame, and a tire sidewall secured to said four tires;
c. a frame securing means holds said tires to said frame;
d. a sidewall securing means secures said side wall to said four tires; and
e. a flexibility of said four tires and said sidewall provides for a secure attachment therebetween.

2. The house using a tire frame assembly of claim 1, wherein:
a. said frame securing means is a crimpable U-shaped fastener; and
b. said sidewall securing means is an S-shaped hook.

3. The house using a tire frame assembly of claim 1, wherein:
a. said support panel is secured at a lower portion thereof to a support mechanism to form said tire frame assembly; and
b. said support mechanism has secured thereto at least two of said support panel.

4. The house using a tire frame assembly of claim 3, wherein:
a. said support mechanism includes a channel secured to a support member;
b. said support member is a severed tire tread;
c. said channel is a U-shaped member;
d. a base of said U-shaped member is secured to said severed tire tread;
e. said channel receives a side of said frame; and
f. said side of said frame in secured in said channel.

5. The house using a tire frame assembly of claim 4, wherein said severed tire tread is at least two meters long.

6. The house using a tire frame assembly of claim 4, wherein:
a. said frame includes at least four metallic bars of a suitable shape;
b. said four metallic bars are joined in generally rectangular shaped by four arcuate corner pieces; and
c. a joining mechanism secures an end of said arcuate corner piece to an end of said bar.

7. The house using a tire frame assembly of claim 6, wherein:
a. a joining device secures one frame to another frame to form part of a wall of said house;
b. an interior coating and an exterior coating is secured to said wall;
c. insulation is placed between said interior coating and said exterior coating to complete said wall.

8. The house using a tire frame assembly of claim 6, wherein said joining device to secure one frame to another frame to form part of a wall of said house is a clamp.

9. The house using a tire frame assembly of claim 6, wherein said frame is telescoping in nature.

10. The house using a tire frame assembly of claim 6, wherein said tire panel includes eight tires.

11. The house using a tire frame assembly of claim 6, wherein said tire panel includes six tires.

12. The house using a tire frame assembly of claim 6, wherein:
a. said S-hook has a bead end secured to said tire sidewall;
b. said S-hook has a tire end oppositely disposed from bead end; and
c. said tire end is secured in said tire.

13. The house using a tire frame assembly of claim 12, wherein said corner piece receives said rod in a female/-male relationship.

14. The house using a tire frame assembly of claim 12, wherein said rod includes more than one piece.

15. The house using a tire frame assembly of claim 12, wherein said channel fastener is a nut and bolt assembly.

16. A support panel for using at least one discarded vehicle tire as housing material wherein:
a. said support panel includes a frame mechanism, at least four tires mounted in said frame, and a tire sidewall secured to said four tires;
b. a frame securing means holds said tires to said frame;
c. said frame includes at least four metallic bars of a suitable shape;
d. said four metallic bars are joined in generally rectangular shaped by four arcuate corner pieces;
e. a joining mechanism secures an end of said arcuate corner piece to an end of said bar;
f. a sidewall securing means secures said side wall to said four tires; and
g. a flexibility of said four tires and said sidewall provides for a secure attachment therebetween.

17. The support panel of claim 16, wherein:
a. said frame securing means is a crimpable U-shaped fastener;
b. said crimpable U-shaped fastener is inserted through a tread of said tire;
c. two parallel arms of said crimpable U-shaped fastener receive said rod therebetween;
d. said parallel arms are crimped around said rod to hold said tire in said frame;
e. said sidewall securing means is an S-shaped hook;
f. said S-hook has a bead end hooked around a bead of said tire sidewall;
g. said S-hook has a tire end oppositely disposed from bead end; and
h. said tire end is hooked around a bead of said tire.

18. A method using a discarded vehicle tire to form a dwelling, comprising:
a. assembling a plurality of tires and frame materials;
b. assembling a frame from said frame materials;
c. securing at least four tires in said frame;
d. securing a tire sidewall secured to said four tires; with a flexibility of said four tires and said sidewall providing for a secure attachment therebetween;
e. forming a tire panel; and
f. securing said tire panel to a support.

19. The method of claim 18, further comprising:
a. securing a first said tire panel to a second said tire panel;
b. forming a wall from a plurality of said tire panel; and
c. finishing a house.

20. The method of claim 19, further comprising:
a. insulating said wall;
b. applying an interior coating to said wall; and
c. applying an exterior coating to said wall.

* * * * *